US007132932B2

(12) United States Patent
Namm et al.

(10) Patent No.: US 7,132,932 B2
(45) Date of Patent: Nov. 7, 2006

(54) METHOD AND APPARATUS FOR LOCATING A FIRE HOSE

(75) Inventors: Joseph C. Namm, Plantation, FL (US); George R. Cain, Jr., Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 170 days.

(21) Appl. No.: 10/830,687

(22) Filed: Apr. 23, 2004

(65) Prior Publication Data

US 2005/0237193 A1 Oct. 27, 2005

(51) Int. Cl.
*G08B 13/14* (2006.01)

(52) U.S. Cl. ..... 340/435; 340/572.1; 340/572.3; 340/572.4; 340/572.6; 340/572.8; 340/568.2; 340/568.8

(58) Field of Classification Search ..... 340/435, 340/572.1, 572.6, 568.2, 568.8, 572.3, 572.4, 340/568

See application file for complete search history.

(56) References Cited

U.S. PATENT DOCUMENTS 5,689,238 A * 11/1997 Cannon et al. ..... 340/572.1
6,496,112 B1 12/2002 Vega
6,600,418 B1 * 7/2003 Francis et al. ..... 340/572.1

FOREIGN PATENT DOCUMENTS

JP 2003388692 * 11/2003

* cited by examiner

*Primary Examiner*—Tai Nguyen
(74) *Attorney, Agent, or Firm*—Barbara R. Doutre

(57) ABSTRACT

One or more RFID tags (104) are integrated into a fire hose (102) to facilitate an individual's exit from a structure. A portable interrogator (106) worn by the individual interrogates the closest RFID tag (104). Each RFID tag (104) has location information stored therein which gets decoded upon interrogation by the portable interrogator (106). The RFID location information assists the individual in locating the hose (102) and following the hose towards its source point (110) and out of the structure.

16 Claims, 2 Drawing Sheets

METHOD AND APPARATUS FOR LOCATING A FIRE HOSE

TECHNICAL FIELD

This invention relates in general to location tracking and more particularly to tracking the location of a fire hose.

BACKGROUND

When working within a burning structure the lack of visibility can cause firefighters and rescue workers to become disoriented and sometimes lost. One method fire/rescue workers use for determining location is to follow a fire hose. However, the fire hose may be difficult to find and may become coiled which can cause confusion as to which direction of the hose to follow out of the structure. Accordingly, it would be beneficial to have a way of facilitating a fire/rescue worker's way out of a structure.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
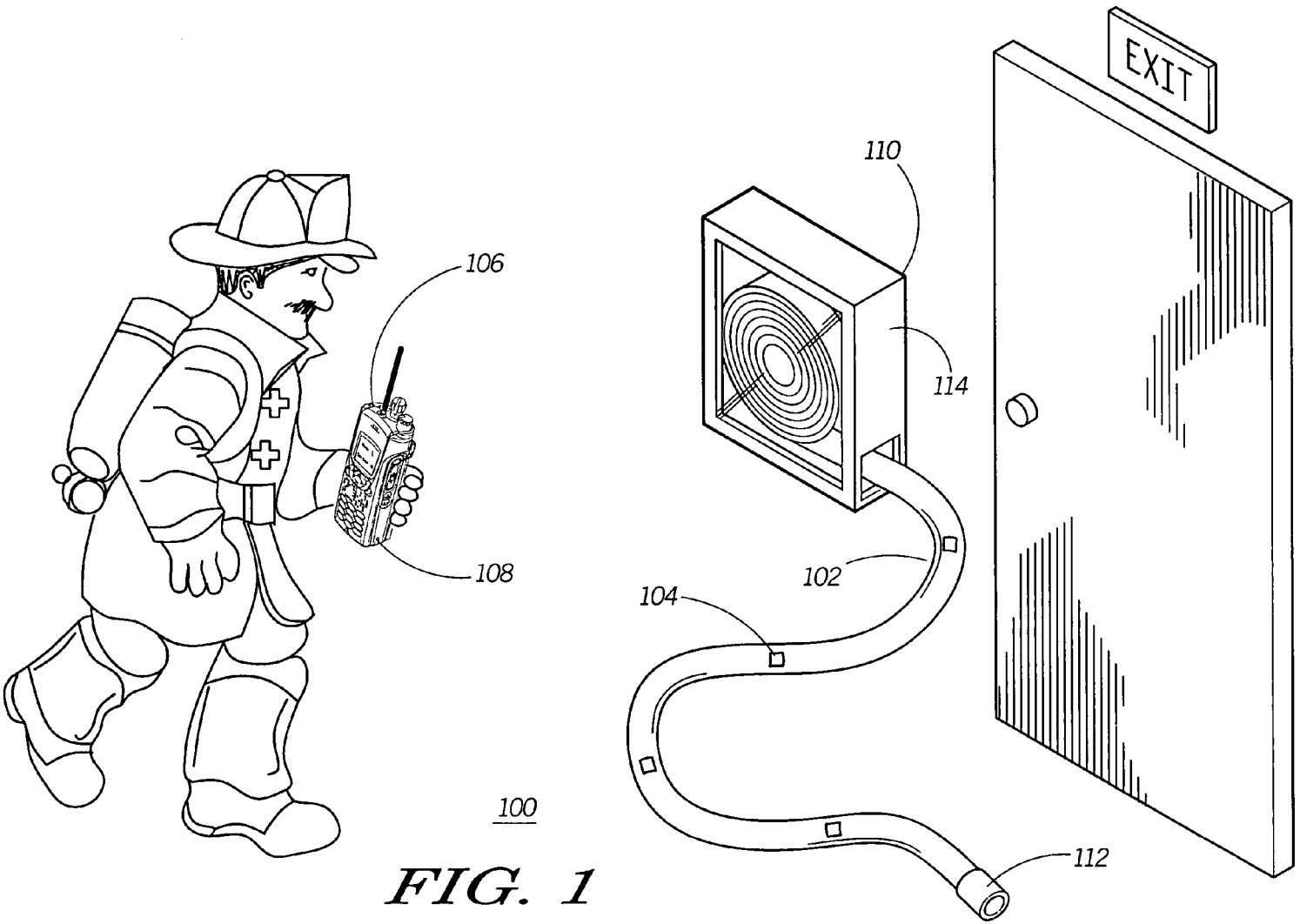
FIG. 1 is a block diagram of a location identification system in accordance with the present invention.

While the specification concludes with claims defining the features of the invention that are regarded as novel, it is believed that the invention will be better understood from a consideration of the following description in conjunction with the drawing figures, in which like reference numerals are carried forward.

Radio frequency identification ("RFID") tags and radio frequency identification tag systems are known, and find numerous uses. For example, radio frequency identification tags are frequently used for personal identification in automated gate sentry applications protecting secured buildings or areas. Information stored on the radio frequency identification tag identifies the person seeking access to the secured building. Older systems require the person accessing the building to insert or swipe a programmed identification tag into or through a reader for the system to read the information from the identification tag.

In newer systems, the user simply holds or places the radio frequency identification tag near a base station, which is coupled to a security system securing the building or area. The base station transmits an excitation signal to the radio frequency identification tag that powers circuitry contained on the radio frequency identification tag. The circuitry, responsive to the excitation signal, communicates the stored information from the radio frequency identification tag to the base station, which receives and decodes the information. The read information is communicated to the security system and, if appropriate, access is granted to the individual. In general, radio frequency identification tags are capable of retaining and, in operation, transmitting a substantial amount of information—sufficient information to uniquely identify individuals, packages, inventory and the like.

In accordance with the present invention, there is provided herein the integration of one or more RFID tags within a fire hose for the purpose of location tracking. When interrogated, the RFID tag transmits data which indicates the location of the fire hose. When more than one RFID tag is used, the location of the tag relative to other tags within the hose is also provided. In accordance with the present invention, a portable communication device used by the firefighter includes an RFID interrogator to interrogate the RFID tag and to receive and decode the location data. The location data is communicated to the firefighter by the portable communication device to facilitate egress from the structure.

FIG. 1 is a block diagram of a location identification system 100 in accordance with the present invention. System 100 includes a fire hose 102 having one or more radio frequency identification (RFID) tags 104 integrated therein, each RFID contains location data identifying the hose location and preferably the RFID tag location within the fire hose. A portable RFID interrogator 106 is integrated within a portable communication device 108, such as a two-way radio, for decoding the location data. In accordance with the present invention, upon interrogation by the RFID interrogator 106, the nearest RFID tag 104 transmits location data to the communication device 108 indicating the location of the fire hose 102 and preferably the location of the closest RFID tag relative to the other RFID tags. The firefighter receives the location information at the portable communication device 108 and locates the hose 102. Once the firefighter locates the hose he or she can follow the hose to a source point 110.

Buildings often have several fire hoses, so an example of the stored data might be "hose number, hose section" to identify a hose in a particular area of the building and the section of that hose. To facilitate egress from the structure, a plurality of RFID tags are preferably integrated within the fire hose 102, each RFID tag 104 having relative location information stored therein. Fire hoses are typically fifty feet in length and include a male coupling 112 that leads into the structure and a female coupling 114 that leads out. Thus, one configuration for the integration of the RFID 104 into the hose 102 would be to locate to the RFID five to ten feet from each end of the hose and in the middle of the hose. Each RFID 104 stores a distinguishable identifier indicating its relative location within the hose. In this configuration, the RFID could identify its relative location using "middle", "male" and "female" indicators. The portable communication device 108 emits an audible and/or visual alert to the fire fighter indicating the location of the RFID tag 104 within the fire hose. The indication of a male coupling 112 leads the fire fighter into the structure while the indication of the female coupling 114 leads the firefighter out of the structure.

Additional RFID tags can be dispersed throughout the hose and a variety of location identifiers can be used. For example, the plurality of RFIDs 104 can be sequentially numbered and interspersed at predetermined distances along the fire hose 102. As the firefighter moves along the hose 102, the order of the numbering indicates which direction the firefighter should take. The portable communication device 108 emits an audible and/or visual alert to the fire fighter indicating the location of the RFID within the hose. For example, the number "one" or a "zero" can be used to indicate the source point of the hose. Thus, when the firefighter locates the hose at say a point identified by one of the plurality of RFID tags as "ten" the fire fighter knows that the next RFID he/she should encounter is "nine" in order to lead to the exit. If the fire fighter moves in the wrong direction, the next RFID will indicate the number "eleven" and the firefighter can change direction so that the RFID tags are descending in order. Lettering, symbol representations of varying intensity, distance indicators or other visual or audible identifiers can be used to represent RFID location along the hose.

Figure 2:
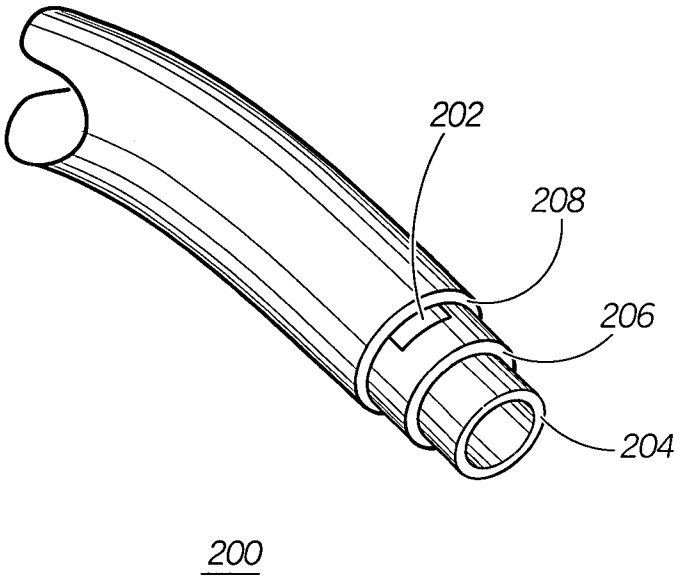
FIG. 2 is an example of fire hose construction having an RFID integrated therein in accordance with the present invention.

FIG. 2 depicts an example of fire hose construction 200 having an RFID tag 202 integrated therein. Construction of the hose 200 preferably consists of a few layers: an inner sealed layer (e.g. rubber) 204 with one or more outer layers of woven material (e.g. woven polyester) 206, 208. The RFID 202 is preferably laid between the outer, woven layers 206, 208 during construction of the hose. Depending on the construction of the hose, other integration means of integrating the RFID to the hose could also be used.

Figure 3:
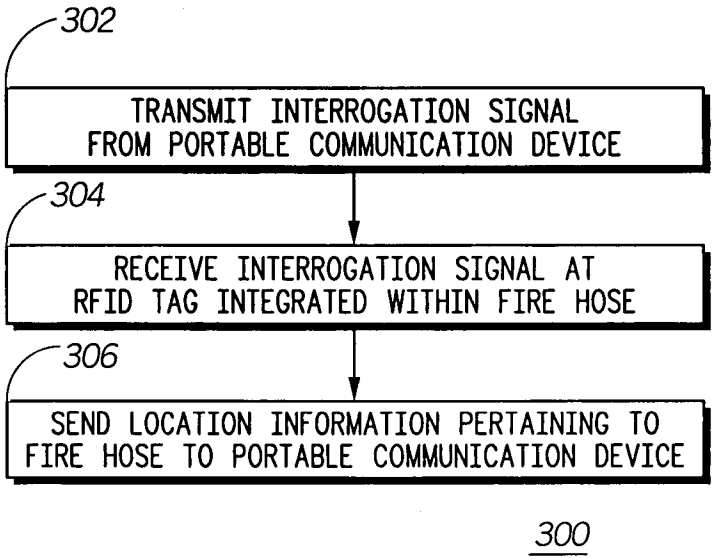
FIG. 3 is a flow chart of a location identification method in accordance with the present invention.

FIG. 3 is a flow chart of a location identification method 300 in accordance with the present invention. The method of identifying location 300 comprises the steps of transmitting an interrogation signal from a portable communication device 302, receiving the interrogation signal at an RFID tag integrated within a fire hose 304 and sending location information pertaining to the fire hose to the portable communication device from the RFID tag 306.

When firefighters are working within a burning structure, there are always fire hoses connected at various points external to the structure or within stairways or other exits ways within the structure. Passive RFID tags can now be interrogated at distances in excess of fifty feet. By interrogating with a transmission directed from a portable interrogator, RFID tags coupled to a fire hose can now lead the firefighter to the closest hose and then direct the firefighter to the building's exit.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An apparatus for facilitating an individual's exit from a structure, comprising:

a fire hose;

a plurality of radio frequency identification (RFID) tags coupled to the fire hose; and a portable interrogator worn by a user for interrogating the plurality of RFID tags and determining the location each RFID tag relative to others within the hose thereby leading the user to the fire hose and out of the structure by following the RFID tags along the hose.

2. The apparatus of claim 1, wherein each RFID tag comprises a passive RFID.

3. The apparatus of claim 1, wherein the portable interrogator is integrated within a portable radio.

4. The apparatus of claim 3, wherein the portable radio emits an audible and/or visual signal to indicating the location of the fire hose.

5. A location identification system, comprising:

a fire hose;

a plurality of radio frequency identification (RFID) tags integrated within the fire hose, each of the plurality of RFID tags containing data identifying the RFID tag location within the fire hose and location of each RFID tag relative to each other;

a portable communication device having a RFID interrogator integrated therein for decoding the data; and wherein upon interrogation by the RFID interrogator, at least one of the plurality of RFID tags transmitting the data to the communication device indicating the location of the fire hose and the RFID tag location within the hose relative to other RFID tags, the plurality of RFID tags leading to an exit of a structure.

6. The location identification system of claim 5, wherein the communication device comprises a portable radio.

7. The location identification system of claim 6, wherein the data is used by a firefighter to locate the fire hose.

8. The location identification system of claim 7, wherein the portable communication device provides one or more of an audible alert and visual alert indicating the location of the fire hose and the RFID tag location within the fire hose.

9. The location identification system of claim 7, wherein the RFID tag location within the fire hose indicates a direction of egress to a user of the portable communication device.

10. The location identification system of claim 9, wherein the RFID tag locations are numbered.

11. The location identification system of claim 10, wherein the RFID tag locations are sequentially numbered over predetermined distances along the fire hose.

12. The location identification system of claim 11, wherein descending order of the RFID tag locations indicates the direction of egress for the user.

13. The location identification system of claim 11, wherein ascending order of the RFID tag locations indicates the direction of egress for the user.

14. The location identification system of claim 11, wherein the RFID tag locations are lettered.

15. The location identification system of claim 14, wherein the RFID tag locations are identified as middle, male and female.

16. A method of identifying location, comprising the steps of:

transmitting an interrogation signal from a portable communication device;

receiving the interrogation signal at a radio frequency identification (RFID) tag integrated within a fire hose;

sending location information pertaining to the fire hose to the portable communication device from the RFID tag, the location information providing the location of the closest RFID tag relative to other RFID tags within the hose; and following the RFID tags to exit a structure.

* * * * *